US010065302B2

(12) United States Patent
Wilkinson

(10) Patent No.: US 10,065,302 B2
(45) Date of Patent: Sep. 4, 2018

(54) REVERSIBLE HAND TOOL

(76) Inventor: David Wilkinson, Casula (AU)

( * ) Notice: Subject to any disclaimer, the term of this patent is extended or adjusted under 35 U.S.C. 154(b) by 1201 days.

(21) Appl. No.: 13/700,541

(22) PCT Filed: May 26, 2011

(86) PCT No.: PCT/AU2011/000642
§ 371 (c)(1),
(2), (4) Date: Jun. 7, 2013

(87) PCT Pub. No.: WO2011/146997
PCT Pub. Date: Dec. 1, 2011

(65) Prior Publication Data

US 2013/0269117 A1 Oct. 17, 2013

(30) Foreign Application Priority Data

May 28, 2010 (AU) ..... 2010902358

(51) Int. Cl.

| | |
|---|---|
| ***B25B 23/00*** | (2006.01) |
| ***B25B 15/00*** | (2006.01) |
| ***B25F 1/04*** | (2006.01) |
| ***B25B 15/02*** | (2006.01) |
| ***B25G 1/06*** | (2006.01) |
| ***B25F 1/02*** | (2006.01) |

(52) U.S. Cl.
CPC ..... *B25F 1/04* (2013.01); *B25B 15/02* (2013.01); *B25B 23/0042* (2013.01); *B25F 1/02* (2013.01); *B25G 1/063* (2013.01)

(58) Field of Classification Search
CPC ..... B25B 15/02; B25B 23/0042; B25B 15/20; B25G 1/06; B25G 1/063; B25G 1/085; B25F 1/04; B25F 1/02
See application file for complete search history.

(56) References Cited

U.S. PATENT DOCUMENTS

| | | | | | |
|---|---|---|---|---|---|
| 1,503,047 | A * | 7/1924 | Hendrickson | B25B 15/04 | 81/32 |
| 2,642,907 | A * | 6/1953 | Alexander | B25G 1/00 | 81/177.4 |
| 2,674,286 | A * | 4/1954 | Carson | B25B 15/02 | 81/177.1 |
| 2,718,249 | A * | 9/1955 | Hill | B25B 15/02 | 81/177.4 |
| 3,255,792 | A * | 6/1966 | Beck | B25G 1/00 | 279/76 |
| 3,319,676 | A * | 5/1967 | Belanger | B25B 15/02 | 7/165 |
| 5,964,132 | A * | 10/1999 | Chen | B25B 15/02 | 81/177.2 |
| 2011/0083536 | A1* | 4/2011 | Palmisano | B25B 15/02 | 81/439 |
| 2014/0144299 | A1* | 5/2014 | Palmisano | B25B 23/0035 | 81/439 |

* cited by examiner

*Primary Examiner* — Bryan R Muller
(74) *Attorney, Agent, or Firm* — Galgano IP Law PLLC; Thomas M. Galgano

(57) ABSTRACT

A reversible hand operated work tool comprising; a shaft including first and second working ends at opposite ends of the shaft; a co operating handle mounted on the shaft and capable of sliding therealong. The hand tool can be adjusted to move from a first working orientation to a second orientation by sliding the handle along the shaft mtennediate said working ends and without jtatnoving the handle form the shaft.

16 Claims, 13 Drawing Sheets

FIGURE 5a–h

REVERSIBLE HAND TOOL

BACKGROUND

The present invention relates to improvements in hand tools and particularly hand tools which have reversible work functions. The invention further relates to a reversible tool which has a handle which slides along a shaft enabling the tool to be operated on one mode and then reversed to a second working mode without removing the handle from the shaft. The invention further relates to a hand tool which has improved functionality, is convenient to use and which can be locked into one or other working mode. The invention also provides a reversible tool in which a handle is retained on the shaft as it slides along the shaft to adopt separate work modes.

PRIOR ART

There are in existence a variety of hand tools which are each designed for performance of specific functions. Typically, these devices are held by a user for manual operation of their work function. A commonly used work tool is a screw driver. The working end of the screw driver is selected according to the compatibility with the head of the screw that the tool is used with.

Over the years, various types of combination pocket tools have been provided using a handle for holding a shaft having different tools, bits or tool drives on each end. Some tools have had a combination of tools of different types or sizes.

The combination hand tools have been provided to enable a user to select different working ends removing the need to carry two tools for two different work purposes. The known reversible tools include a handle and a shank that has a working end, such as a screwdriver blade integrally formed at one end. Another working formation may be integrally formed on the opposite end of the shank. A detent located on the shaft, secures the tool or the tool drive within a cavity in the handle. A second detent, on the tool drive, helps to secure the tool drive within the handle when the tool is in use.

By way of example, U.S. Pat. No. 4,779,493 discloses a combination pocket tool which has a shank and a handle. The shank has a tool at one end and a tool drive at the other end. The handle has a steel sleeve embedded within a hollow cavity. A first detent on the tool drive secures the tool or the tool drive within the cavity of the handle. A second detent on the tool drive assists in securing the tool drive within the cavity or secures a detachable tool to the tool drive. In this case the handle must be removed to expose the second alternative working end then replaced onto the shank.

U.S. Pat. No. 5,533,429 discloses a fastener driving tool insert. In order to enhance the effectiveness of a tool for driving a fastener in a clockwise and/or counter clockwise direction, the tool includes a fastener engaging portion, a rotational movement imparting portion, and a releasable retaining portion. The fastener engaging portion is adapted to engage a fastener for clockwise and/or counter clockwise driven movement in response to rotational movement of the fastener engaging portion. The rotational movement imparting portion is adapted to impart rotational movement to the fastener engaging portion to thereby impart driven movement of the fastener in the clockwise and/or counter clockwise direction. The releasably retaining portion is adapted to releasably retain the fastener engaging portion in operative relationship with the rotational movement imparting portion.

Conventional screw drivers are generally configured to have a keystone tip or a Phillips head tip of a unitary size.

Hence, in use, it is necessary to select the type of screwdriver suitable for use in driving screws of different sizes. In the past attempts have been made to improve on the unitary function and practicality of conventional drivers. The reversible screwdrivers typically have a handle having a shank fixedly provided at its front end and with an interior fitted with a pull handle having a compartment containing a plurality of working bits. The compartment of the pull handle is provided for keeping a plurality of bits of various specifications and sizes. The user may pick out a suitable bit and insert it into a receiving hole at a front end of the shank. The screwdriver may thus be used for driving screws of various sizes and specifications.

Although these screwdriver structures can achieve their respective intended purposes, they have some drawbacks. Although the screwdriver is provided with a plurality of bits to improve its practicality, it is not efficient in moving from one working configuration to another working configuration.

U.S. Pat. No. 5,749,271 discloses a dual purpose ratchet screwdriver including a handle having a chamber in its interior for accommodating a ratchet mechanism, a drive sleeve of the ratchet mechanism being provided to cooperate with a transmission shaft inserted through a hole of the handle. The transmission shaft has a bit at either end, the bit at one end of the transmission shaft being utilized as a structural element for power transmission while the bit at the other end is used to drive a screw.

U.S. Pat. No. 5,901,622 discloses a hand tool with a reversible shaft. The tool comprises a hollow handle accommodating a reversible shaft with a different functionality at each end. The first end of the shaft is configured with an integral telescoping magnetic pick up tool, and a second end of the shaft is adapted to receive modular double-ended screwdriver bits. The reversible shaft is retained within the handle by a conventional spring loaded ball configuration located at the mid-point of the shaft and is prevented from rotating within the handle by preferably two wings projecting radially outwardly from the shaft. The spring loaded ball and the two wings are retained within a corresponding recess and two co-operating slots, respectively. The recess and slots are defined in a metal sleeve molded into the handle.

Screwdrivers with a shaft adapted to retain modular bits which are stored in either the handle or the shaft are well known. Similarly, screwdrivers with modular shafts for different types of screws which are stored in the handle are also well known.

The known reversible screw drivers include a shaft securable within the handle, and configured for a different functionality at each end.

The shaft is interchangeably positionable within the handle in either one of a first position where a first end of the shaft locates within the handle and a second end of said shaft projects outwardly from the handle. A second end of the shaft is adapted to receive screwdriver bits, and a second position where said second end of said shaft locates within said handle and said first end of said shaft projects outwardly from the handle. A hollow handle accommodates a reversible shaft with a different functionality at each end. The reversible shaft is retained within the handle by any suitable means, such as a conventional spring loaded ball preferably located at the mid-point of the shaft and is prevented from rotating within the handle by preferably two wings projecting radially outwardly from the shaft.

To change the function of the tool from a screwdriver to a telescoping tool, the user need only pull out the reversible shaft and re-insert it with the tool facing outward. The cylindrical opening can accommodate the shaft with the screwdriver bit, so that the user does not necessarily have to remove the bit from the shaft and store it before changing functionalities.

There is a need to provide improvements in the known hand tools to increase efficiency of operation and to provide more convenient options for users.

INVENTION

The present invention seeks to ameliorate the above disadvantages of the prior art by providing an improved hand tool which is more convenient to use that the known reversible hand tools.

The present invention provides a hand tool which has reversible work functions. The invention further relates to a reversible tool which has a handle which slides along a shaft enabling the tool to be operated on one mode and then reversed to a second working mode without removing the handle from the shaft. The invention further relates to a hand tool which has improved functionality, is convenient to use and which can be locked into one or other working mode.

In its broadest form the present invention comprises:
a reversible hand operated work tool having a co-operating handle and shaft including work ends at oppose ends of the shaft; wherein the hand tool can be changed from one working mode to another working mode without removal of the handle from the shaft.

In one broad form the present invention comprises:
a hand operated tool comprising:
a shaft having first and second working ends;
the handle connected to the shaft and capable of movement relative to the shaft;
wherein the handle and shaft co operate to allow the handle to move along the shaft between a first working position which allows the first working end to be used while the user grips the handle and a second working position which allows the second working end to be used while the user grips the handle;
and wherein the handle is retained on the shaft while the tool moves between the first and second working positions.

According to a preferred embodiment, the handle and shaft are concentric.

According to a further embodiment, the handle is lockable to prevent relative movement between the shaft and the handle when either the first or second working positions have been selected.

The handle preferably comprises first and second sleeve members which are retained concentrically along the shaft and which engage a locking assembly. According to a preferred embodiment the locking assembly preferably comprises an inner bearing which receives the shaft, a retaining member which retains the inner bearing and a housing. The retaining member includes a locking arm which extends from the housing and allows the retaining member to co operate with the bearing to move the bearing between a first mode of locking engagement with the shaft and a second unlocked mode in which the bearing allows relative movement between the shaft and locking assembly. The shaft according to one embodiment has a flat surface which co operates with the locking arm to effect locking as required. Locking prevents relative axial movement between handle and shaft. Torque is transmitted between the mating surfaces of the handle and shaft.

According to a preferred embodiment, the locking assembly receives a pivot pin which is anchored in either one or both of the sleeve members of the handle and allows the locking assembly to pivot about the pin (up and down), so it moves between the locking and unlocked modes.

In another broad form the present invention comprises:
a locking assembly for a hand operated tool comprising:
a shaft having first and second working ends;
the handle connected to the shaft and capable of movement relative to the shaft;
wherein the handle and shaft co operate to allow the handle to move along the shaft between a first working position which allows the first working end to be used while the user grips the handle and a second working position which allows the second working end to be used while the user grips the handle;
and wherein the handle is retained on the shaft while the tool moves between the first and second working positions; the locking assembly comprising a retaining member which allows the handle assembly to be selectively locked to the shaft by rotation of the retaining member about a pivot pin connected to the handle thereby allow the locking assembly to be moved between a locked mode and unlocked mode. Preferably the handle is prevented from relative rotation about the shaft and the shaft is fully retained on the shaft.

According to a preferred embodiment, the handle and shaft are concentric. According to a further embodiment, the handle is lockable to prevent relative axial movement between the shaft and the handle when either the first or second working positions have been selected.

At each end of the shaft is a working formation such as but not limited to a screw driver head such as a Philips head or other working formation such as a flat head screw driver, alien key (male or female), a torx formation. Different functionality can be provided at each end and used interchangeably by sliding the handle along the shaft to one end or the other. This is quite different from the prior art in that no part of the assembly need be removed and replaced to change from one working mode to another working mode.

In each working mode the working end is located distally from the handle but it will be appreciated that the handle can be located at selected positions along the shaft to alter the torque which can be applied to the working end.
For convenience, the specification will refer to "screwdrivers", but it should be clearly understood that the invention is applicable to various reversible hand tools having a handle which moves relative to a shaft between two working positions and which can have a variety of working ends which can include socket and spanner profiles.

These and other objects of this invention, which will become more apparent upon consideration of the attached claims and drawings and of the following detailed description, are provided in accordance with the preferred embodiment of this invention illustrated by an assembly which enables Although the invention will be predominantly described with reference to its application to a reversible screw driver, it will be recognised by persons skilled in the art that the invention has a wide variety of applications and with different working ends beyond those to be described by way of example. For example the invention can be adapted as a child's toy manufactured from such materials as but not limited to plastics and polystyrene.

The present invention provides an alternative to the known prior art and the shortcomings identified. The foregoing and other objects and advantages will appear from the description to follow. In the description reference is made to the accompanying representations, which forms a part hereof, and in which is shown by way of illustration specific embodiments in which the invention may be practiced.

These embodiments will be described in sufficient detail to enable those skilled in the art to practice the invention, and it is to be understood that other embodiments may be utilized and that structural changes may be made without departing from the scope of the invention. In the accompanying illustrations, like reference characters designate the same or similar parts throughout the several views. The following detailed description is, therefore, not to be taken in a limiting sense, and the scope of the present invention is best defined by the appended claims.

BRIEF SUMMARY OF DRAWINGS

The invention will now be described in more detail according to a preferred but non limiting embodiment and with reference to the accompanying illustrations.

DETAILED DESCRIPTION

It will be convenient to hereinafter describe the invention in relation to its application to a screw driver but it will be appreciated that the invention is not limited to that application and may be adapted to alternative constructions. The assembly described herein has advantages over the known art including improved efficiency.

Figure 1:
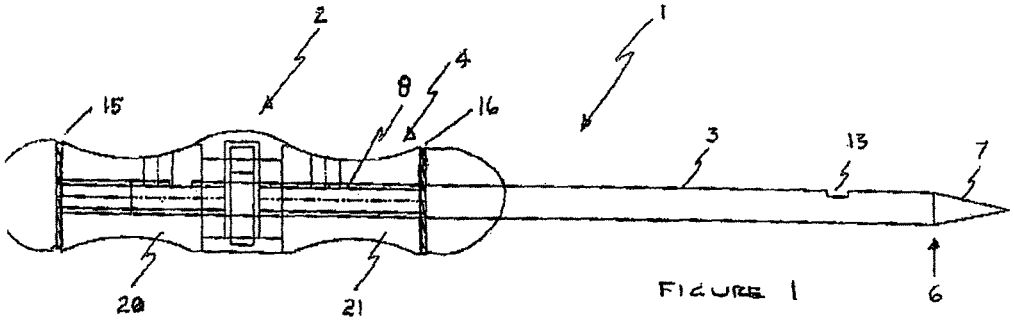
FIG. 1 shows a side elevation view of a reversible hand tool according to a preferred embodiment with the handle set at one end and opposite a first working end.

Referring to FIG. 1 there is shown a side elevation view of a reversible hand tool 1 according to a preferred embodiment. Tool 1 includes handle assembly 2 which is adapted to slide along shaft 3 enabling handle 4 to be set at one end 5 of shaft 3, creating at opposite end 6 a first working formation 7. Handle assembly 2 is connected concentrically to shaft 3 and includes a through passage 8 which allows travel of handle 4 along shaft 3. Handle assembly 2 co operates with shaft 3 to allow the handle 4 to move along the shaft between a first position at end 5 which allows formation 7 of working end 6 to be used while the user grips the handle 4 and a second position 9 (see FIG. 3) which allows the second working formation 10 at end 5 end to be used while the user grips the handle 4. Handle 4 and shaft 3 are concentric. According to a preferred embodiment, the handle 4 is lockable to prevent relative movement between the shaft 3 and the handle 4 when either the first or second working positions 5 or 9 have been selected. Stop 15 is employed to ensure handle 4 does not release from shaft 3.

Figure 2:
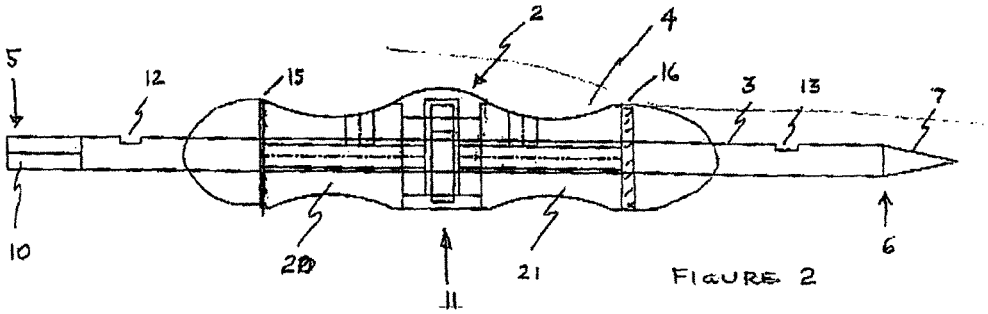
FIG. 2 shows the hand tool of FIG. 1 with the handle in an intermediate position along the shaft between the first and second working ends.
Figure 3:
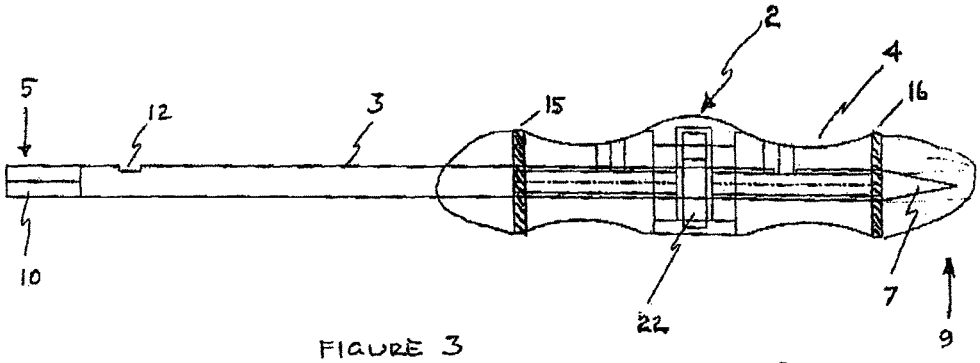
FIG. 3 shows the tool of FIG. 1 with the handle set at the first working end to enable use of the tool at the second working end.
Figure 3A:
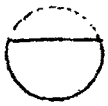
FIG. 3*a* shows a cross section of the shaft.

FIG. 2 shows with corresponding numbering the hand tool 1 of FIG. 1 with the handle assembly 2 in an intermediate position 11 along the shaft 3 between the first and second working ends 5, 6. FIG. 3 shows the tool of FIG. 1 with the handle 4 set at the end 6 to enable use of the formation 10 at end 5. As shown in FIGS. 1-3 shaft 3 includes abbreviations 12 and 13 which allow a locking assembly 22 to engage shaft 3 for the purpose of locking the handle assembly 2 opposite the respective working ends 5 and 6. The handle assembly 2 preferably comprises a locking assembly 22. FIG. 3*a* shows a cross section of the shaft 3.

Figure 4:
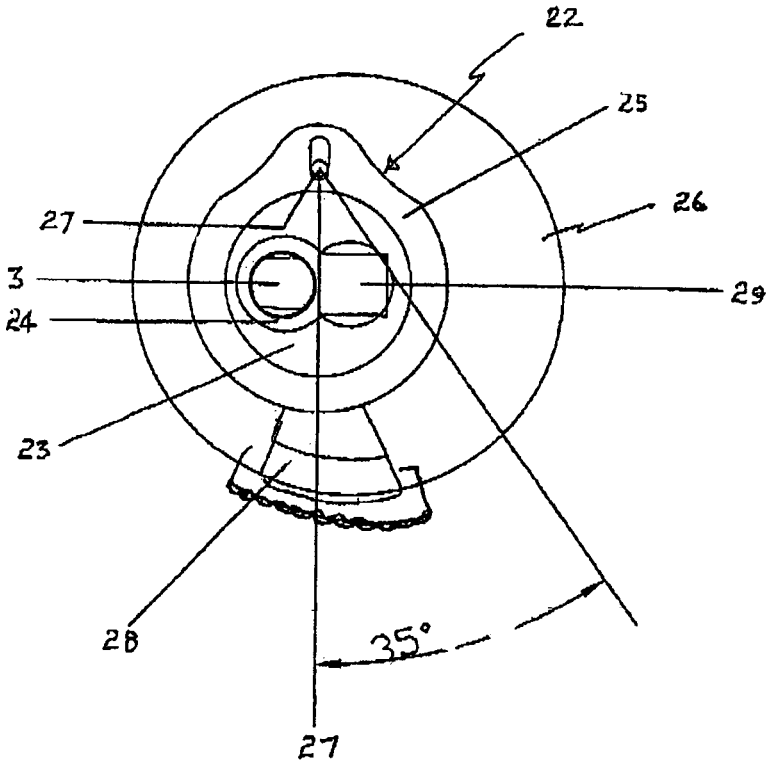
FIG. 4 shows a sectional view through the handle and locking assembly according to a preferred embodiment.

FIG. 4 shows a sectional view through the handle and locking assembly according to one embodiment. Locking assembly 22 preferably comprises an inner bearing 23 which receives the shaft 3 via opening 24. A retaining member 25 retains the inner bearing 23. Both retaining member 25 and bearing 23 are retained in housing 26. Retaining member 25 is retained by a pivot pin 27 and is capable of rotation thereabout. This allows the retaining member 25 to move up and down. The retaining member 25 includes a locking actuator 28 which extends from the housing 26 and allows the retaining member 25 to co operate with the bearing 23 to move the bearing 23 between a locking mode in which shaft 3 engages locking recess 29 and an unlocked mode in which shaft 3 is located in opening 24 and the bearing allows shaft 3 to travel relative to locking assembly 22. Bearing 23 allows relative axial movement between the shaft 3 and locking assembly 22 thereby enabling handle assembly 2 to slide along shaft 3. Pivot pin 27 is anchored in one or both of the sleeve members 20 or 21 of the handle 4 and allows the locking assembly 22 to pivot about the pin 27 so it moves between the locking and unlocked modes as required by an operator.

At each end of the shaft 3 working formations 7 and 10 are respectively a flat head screw driver and Philips head but it will be appreciated that other working formations (not shown) may be employed. Different functionality can be provided at each end and used interchangeably by sliding the handle assembly 2 along the shaft 3 to one end or the other. Handle assembly 2 can be located at selected positions along the shaft 3 to alter the torque which can be applied to the working end as required.

Figure 5:
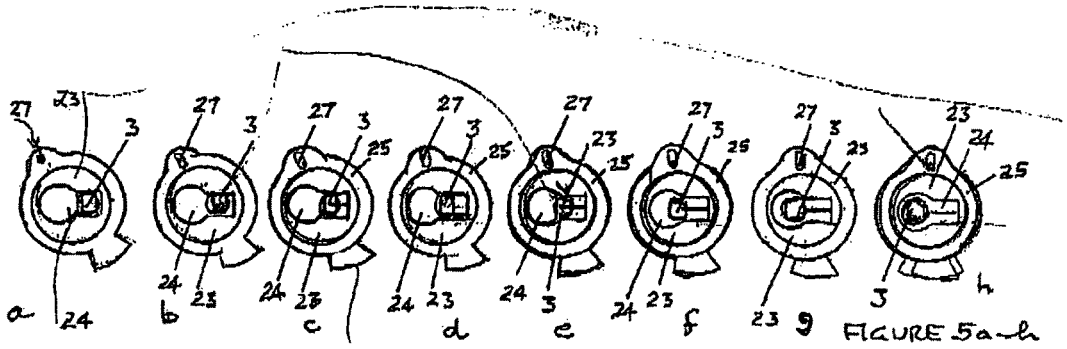
FIGS. 5 *a-h* shows an end elevation view of the locking assembly moving from a locked mode in which the shaft is engaged with the bearing through various stages to an unlocked mode in which the shaft is disengaged from the bearing.

FIGS. 5 *a-h* shows with corresponding numbering an end elevation view of the locking assembly 22 of FIG. 4 as it moves from a locked mode in which the shaft 3 is engaged with the bearing 23 through various stages to an unlocked mode in which the shaft is disengaged from the bearing 23 and is free for axial travel in opening 24.

Figure 6:
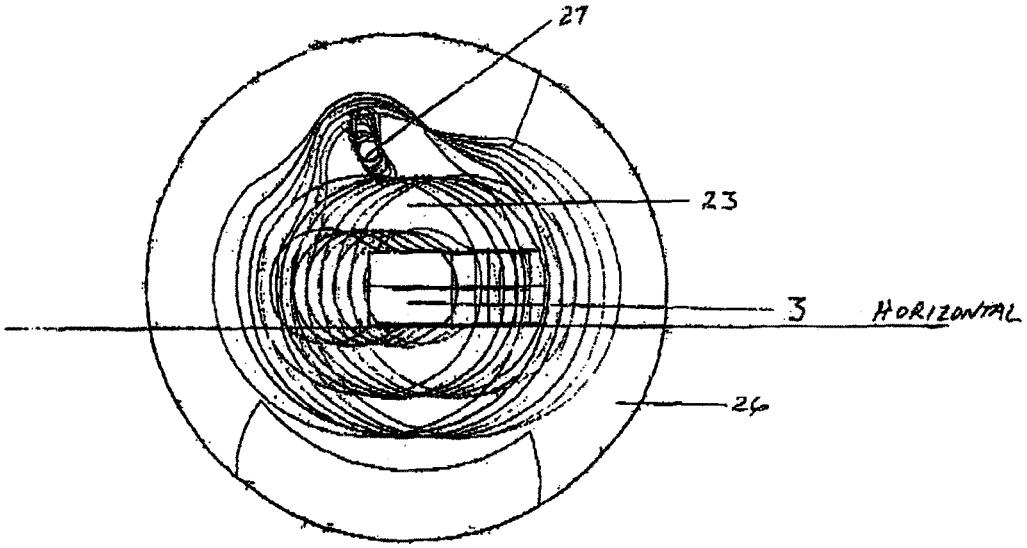
FIG. 6 shows a schematic view of a locking assembly showing the range of movement of the bearing, retainer and anchor pin.

FIG. 6 shows a schematic view of a locking assembly showing the range of movement of the bearing 23, retainer 25 and anchor pin 27. Bearing 23 allows the contact surfaces to remain horizontal. An elongated opening about the pivot pin makes this possible.

Figure 7:
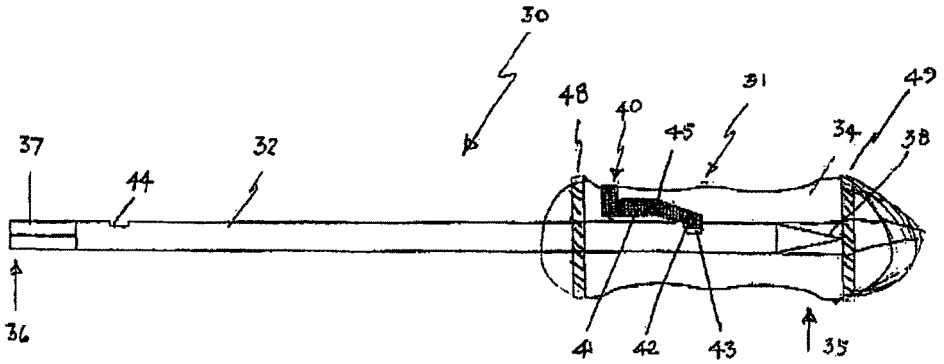
FIG. 7 shows a hand tool similar to that shown in FIGS. 1-3 but with an alternative locking arrangement.

FIG. 7 shows a hand tool 30 similar to that shown in FIGS. 1-3 but with an alternative locking arrangement. Tool 30 includes handle assembly 31 which is adapted to slide along shaft 32 enabling handle 34 to be set at one end 35 of shaft 32, creating at opposite end 36 a first working formation 37.

Handle assembly 31 is connected concentrically to shaft 32 and includes a through passage 38 which allows travel of handle 34 along shaft 32. Handle assembly 31 co operates with shaft 32 to allow the handle 34 to move along the shaft 32 between a first position which allows formation 37 of end 36 to be used while the user grips the handle 34 and a second position (see FIG. 9) which allows the second working formation 39 at end 35 to be used while the user grips the handle 34. Handle 34 and shaft 32 are concentric. Handle 34 is lockable to prevent relative movement between the shaft 32 and the handle 34 when either the first or second working positions have been selected. Locking assembly 40 comprises a pawl 41 terminating in tang 42 pivotally attached to handle 34 via pin 45. FIG. 7 shows locking assembly 40 in locking engagement with shaft 32 as tang 42 is in engagement with recess 43 of shaft 32. Moon shaped discs 48 and 49 operate to prevent release of the handle assembly 31 releasing from shaft 32.

Figure 8:
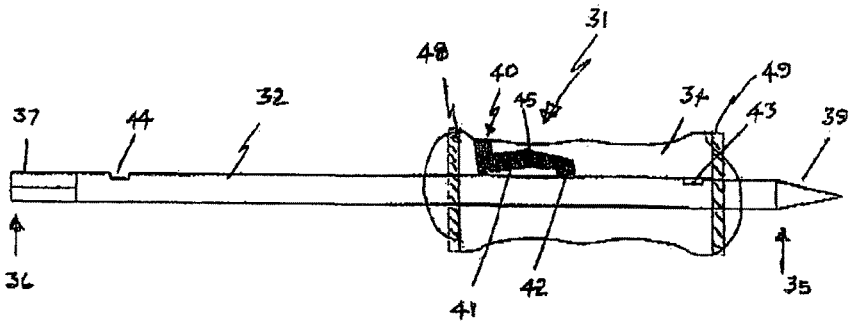
FIG. 8 shows the handle assembly of FIG. 7 moved out of locking engagement with the shaft and moved in the direction of an opposite end.
Figure 9:
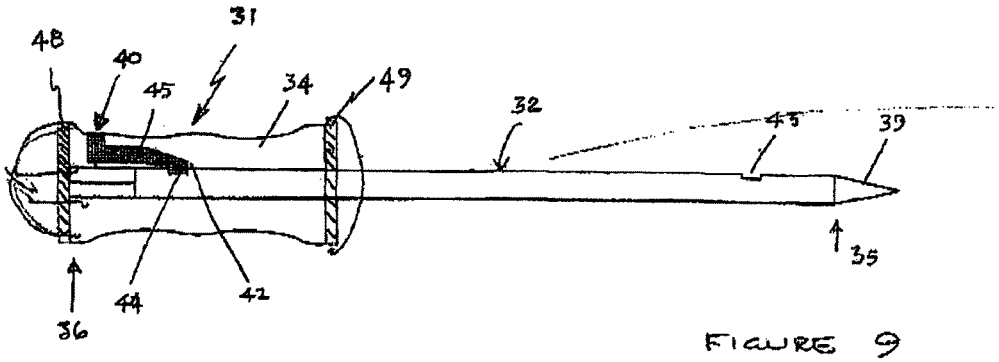
FIG. 9 shows the handle assembly of FIG. 7 locked at one end via a locking assembly.

FIG. 8 shows the handle assembly 31 moved out of locking engagement with shaft 32 and moved in the direction of end 36. FIG. 9 shows the handle assembly 31 locked at end 36 via locking assembly 40. Tang 42 is shown engaging recess 44 of shaft 32 to lock handle assembly 31. Handle assembly 31 can be simply relocated along shaft to either end depending upon which working end is required. In this embodiment, handle assembly 31 can be removed from shaft if required but removal from shaft 32 is not essential to change to the opposite working end of shaft 32.

Figure 10:
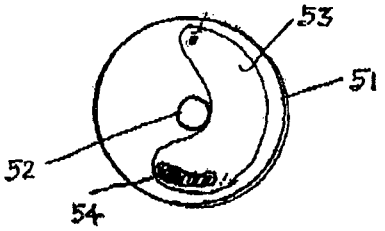
FIG. 10 shows according to one embodiment an end view of a handle assembly which includes a retaining disc which prevents extension of a shaft beyond the handle.
Figure 11:
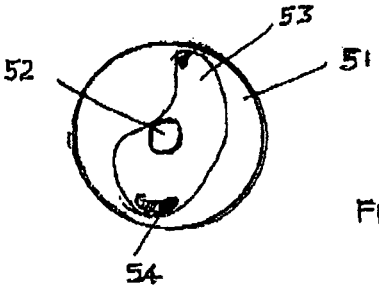
FIG. 11 shows the embodiment of FIG. 11 with retaining disc obstructing the shaft covering.

As a measure of user safety according to a preferred embodiment, and as shown in FIGS. 10 and 11, there is provided at end 50 of handle 51 a spring loaded disc which acts to prevent unwanted movement of shaft 52 axially beyond the end of handle 51. Disc 53 is biased under the action of spring 54 to urge disc 53 over the end of shaft 52 as shown in FIG. 11. Such protection may be provided at either rend of handle 51 as required. This will provide user safety and in particular a safeguard against the shaft stabbing the users hand.

Figure 12:
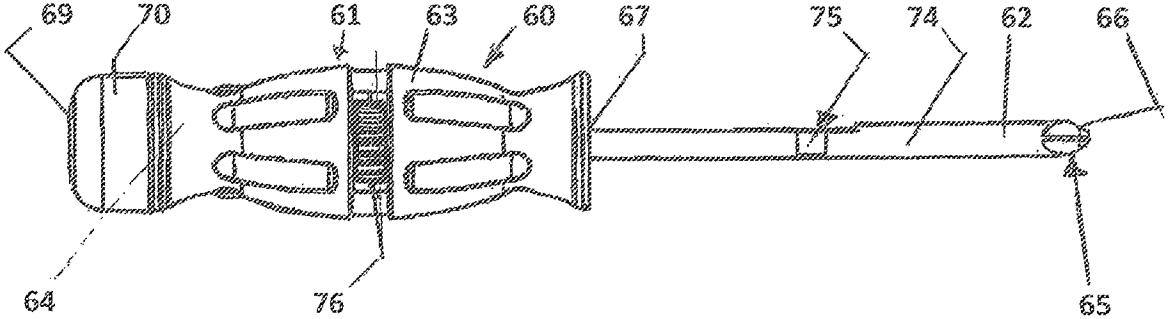
FIG. 12 shows a perspective view of a reversible hand tool according to a preferred embodiment with the handle set at one end and opposite a first working end.

Referring to FIG. 12 there is shown a side elevation view of a reversible hand tool 60 according to a preferred embodiment. Tool 60 includes handle assembly 61 which is adapted to slide along shaft 62 enabling handle 63 to be set at one end 64 of shaft 62, creating at opposite end 65 a first working formation 66. Handle assembly 61 is connected, concentrically to shaft 62 and includes a through passage 67 which allows travel of handle 63 along shaft 62. Handle assembly 61 co operates with shaft 62 to allow the handle 63 to move along the shaft 62 between a first position at end 64 which allows formation 66 of working end 65 to be used while the user grips the handle 63 and a second position (see FIG. 13) which allows the second working formation 68 at end 64 end to be used while the user grips the handle 63. Handle 63 and shaft 62 are concentric. According to a preferred embodiment, the handle 63 is lockable to prevent relative movement between the shaft 62 and the handle assembly 63 when either the first or second working positions 64 or 65 have been selected. Stop 69 of end cap 70 and stop 71 of end cap 72 are employed to ensure handle 63 does not release from shaft 62.

Figure 13:
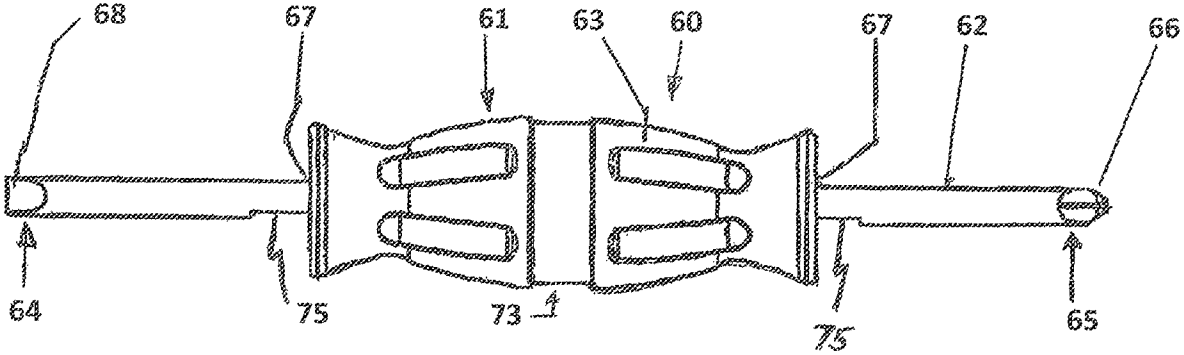
FIG. 13 shows the hand tool of FIG. 12 with the handle in an intermediate position along the shaft between the first and second working ends.

FIG. 13 shows with corresponding numbering the hand tool 1 of FIG. 12 with the handle assembly 61 in an intermediate position 73 along the shaft 62 between the first and second working ends 64 and 65.

Figure 14:
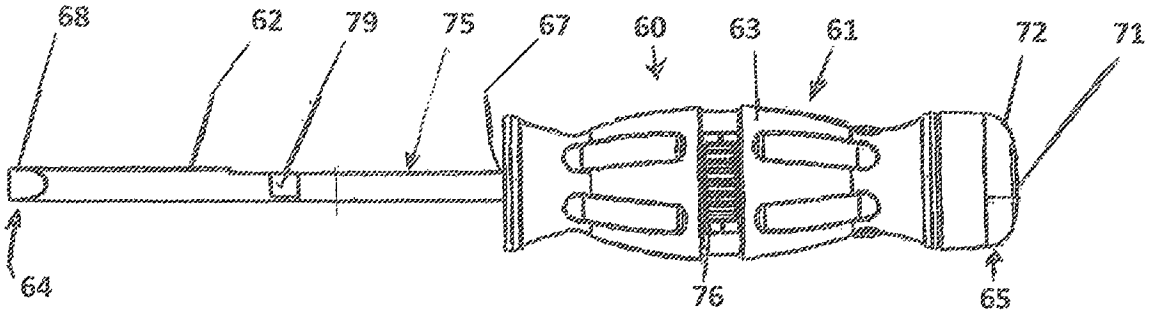
FIG. 14 shows the tool of FIG. 12 with the handle set at an opposite end to enable use of the tool at a second working end.

FIG. 14 shows the tool of FIG. 12 with the handle 61 set at the end 65 to enable use of the formation 68 at end 64. As shown in FIGS. 12-14 shaft 62 includes abbreviations/slots 79 (see FIG. 14) and 74 which allow a locking assembly 76 to engage shaft 62 for the purpose of locking the handle assembly 61 opposite the respective working ends 64 and 65. The handle assembly 61 is retained concentrically along the shaft 62 and which engage a locking assembly 76.

Figure 15:
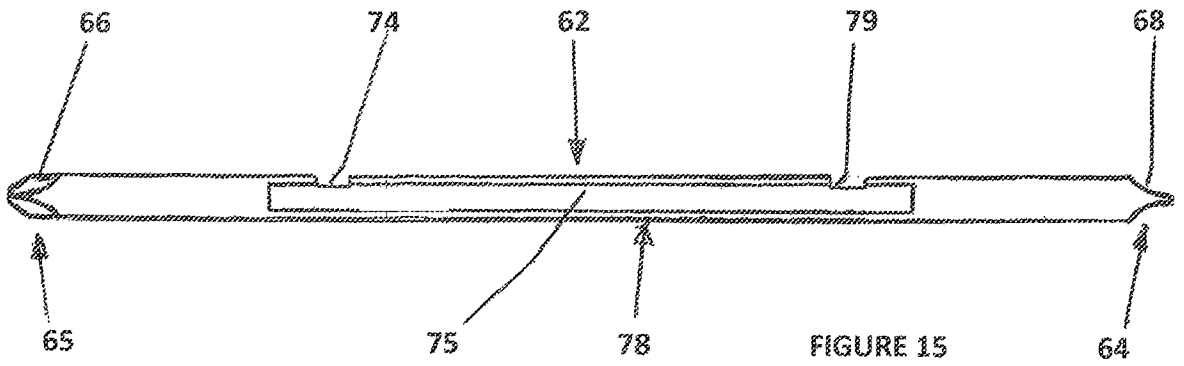
FIG. 15 shows the shaft of FIG. 14 isolated from the handle of FIG. 14.

FIG. 15 shows a side elevation of shaft 62 isolated from the handle assembly 61 of FIG. 12. Shaft 62 comprises a first end 65 with a working formation 66 and a second end 64 with a working formation 68. Intermediate ends 65 and 64 is a profile part or formation 78 which is configured to receive a handle such as handle 63 shown in FIG. 13 and enables handle 63 to be selectively and slidably retained on shaft 62. Formation 78 includes a longitudinal abbreviation/recess 75 and slots 74 and 79.

Figure 16:
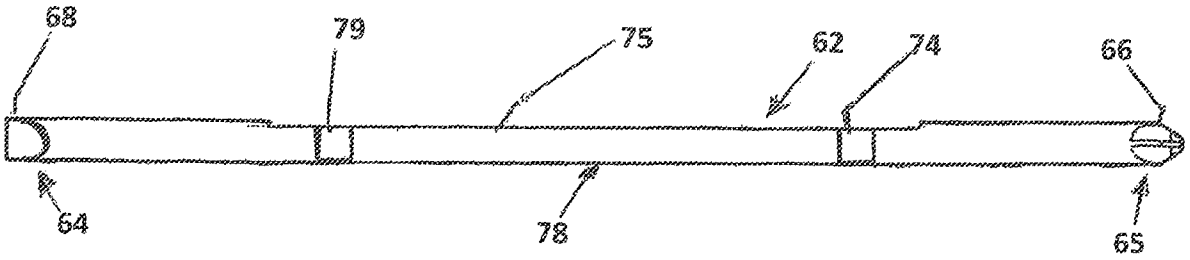
FIG. 16 shows the shaft of FIG. 12 isolated from the handle with ends reversed by rotation 180 degrees.

FIG. 16 shows with corresponding numbering the shaft 62 of FIG. 15 rotated 90 degrees with ends reversed and. includes a longitudinal recess 75 and slots 74 and 79. Longitudinal recess 75 of formation 85 enables engagement with a corresponding profile of a handle (not shown) to enable the handle to be selectively moved along shaft 62. Slots 79 and 74 receive the actuating member 98 (see FIG. 18) to restrain the handle from movement relative to shaft 80 depending upon the end selected for the handle. If working end 81 is to be used, the actuating member of the locking assembly 73 will engage slot 88. Likewise, if working end 83 is to be used, the actuating member 98 of the locking assembly 76 will engage slot 87.

Figure 17:
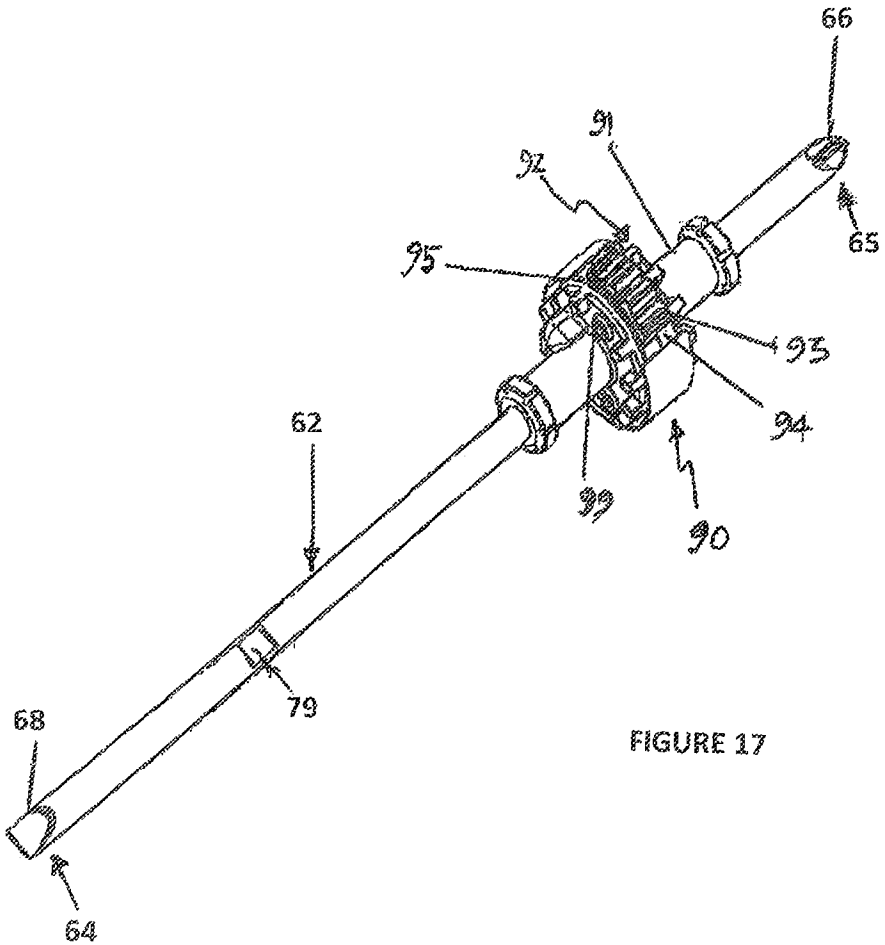
FIG. 17 shows a perspective view of the locking assembly engaging the shaft with handle of FIG. 12 removed for clarity.

FIG. 17 shows with corresponding numbering a perspective view of a shaft 64 incorporating a locking assembly 90 when isolated from the handle assembly 61. Locking assembly 90 is mounted on sleeve 91 which is capable of sliding along shaft 62. Assembly 90 includes a locking member 92 having a formation 93 which is engageable by a users finger and which is connected to a saddle 94. Saddle 94 is capable of moving circumferentially relative to housing 95 to enable locking and unlocking of sleeve 91 about shaft 62 so that a handle can be selectively restrained from movement relative to shaft 62.

Figure 18:
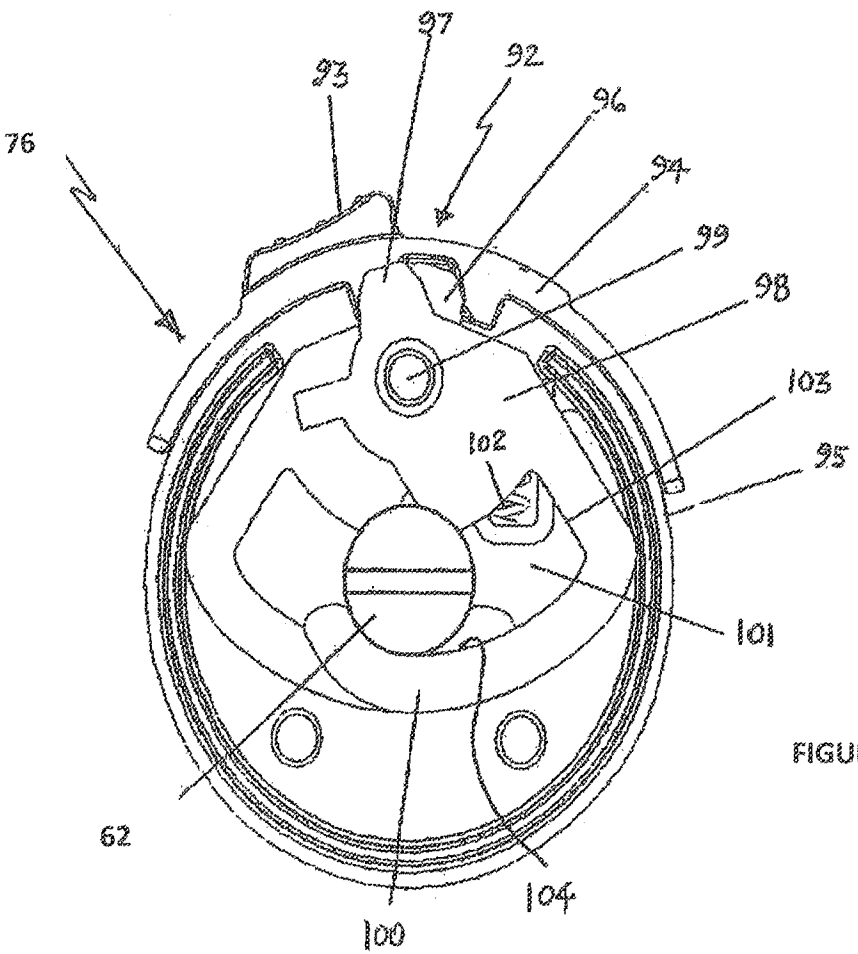
FIG. 18 shows a cross sectional view of the locking assembly co operating with the shaft in the unlocked mode.

FIG. 18 shows a sectional view of locking assembly 76 engaging shaft 62. Assembly 76 includes locking member 92 having a formation 93 which is engageable by a users finger and which is connected to a saddle 94. Saddle 94 is capable of moving circumferentially relative to housing 95 to enable locking and unlocking of housing 95 and sleeve 91 (see FIG. 17) about shaft 62 so that a handle can be selectively restrained from movement relative to shaft 62. Locking member 92 includes a recess 96 which engages tab 97 of actuating member 98. Actuating member 98 is pivotally attached via pivot hinge 99 and terminates in engaging arm 100. Engaging arm 100 engages shaft 62 which moves within slot 101 as actuating member 98 rotates about pivot hinge 99. As actuating member 98 rotates towards shaft 62, shaft 62 is urged into slot 101 and at least one of the profiles 102, 103 and 104 of slot 101 engages one of the corresponding slots 79 and 74 (see FIG. 15) in shaft 62 to capture shaft 62 and prevent movement of the housing 95 along the shaft. Since the assembly 76 is mounted on the handle 63, the handle is prevented from axial sliding along shaft 62. The locking assembly includes a spring bias which urges the actuating member away from engagement with the shaft 62 so that the locking assembly is naturally biased to the unlocked position. Alternatively the actuating member can be biased to the locked position by spring loading. To enable the handle to transfer applied torque to the shaft, a keyway 75 is provided on the shaft to prevent any relative rotational movement between the shaft and the handle.

Figure 19:
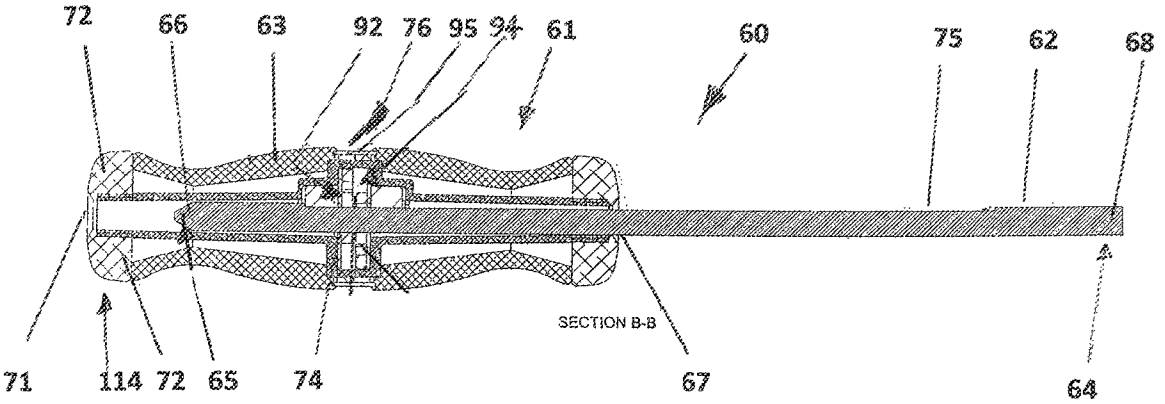
FIG. 19 shows a long sectional view of the assembled work tool of FIG. 14.

FIG. 19 shows a long sectional view through assembled work tool 60 shown in FIG. 14 and with ends reversed. Tool 60 includes handle assembly 61 which is adapted to slide along shaft 62 enabling handle 63 to be set at one end 65 of shaft 62, creating at its opposite end 64 a first working formation 68. Handle assembly 61 is connected concentrically to shaft 62 and includes a through passage 67 which allows travel of handle 63 along shaft 62. Handle assembly 61 co operates with shaft 62 to allow the handle 63 to move along the shaft between a first position at end 65 which allows formation 68 of working end 64 to be used while the user grips the handle 63. Handle 63 and shaft 62 are concentric. According to a preferred embodiment, the handle 63 is lockable to prevent relative movement between the shaft 62 and the handle 63 when either the first or second working positions at ends 65 or 64 of shaft 62 are selected. End cap 72 includes stop 71 and is employed to ensure shaft 62 does not release from handle 63.

Handle assembly 61 includes locking assembly 76. Locking assembly 76 includes a locking member 92 having a formation 93 which is engageable by a user's finger and which is connected to a saddle 94. Saddle 94 is capable of moving circumferentially to enable locking and unlocking of handle assembly 61 about shaft 62 so that a handle can be selectively restrained from movement relative to shaft 62. As locking member 94 is rotated actuating member 98 (see FIG. 18) rotates towards shaft 62. Shaft 62 is urged into recess 128 thereby preventing handle from sliding along shaft 62. Shaft 62 comprises a first end 65 working formation 66 and second end 64 working formation 68. Intermediate ends 65 and 64 is a profile part or formation 75 (see also FIG. 15) which is configured to receive handle 63 to be selectively and slidably retained on shaft 62. Once the locking assembly 76 is engaged, shaft 62 is prevented from axial movement relative to handle 63, by engagement between locking assembly 76 and slot 74. Handle 63 is prevented from relative rotation about shaft 62 by a keyway in locking assembly 76.

Figure 20:
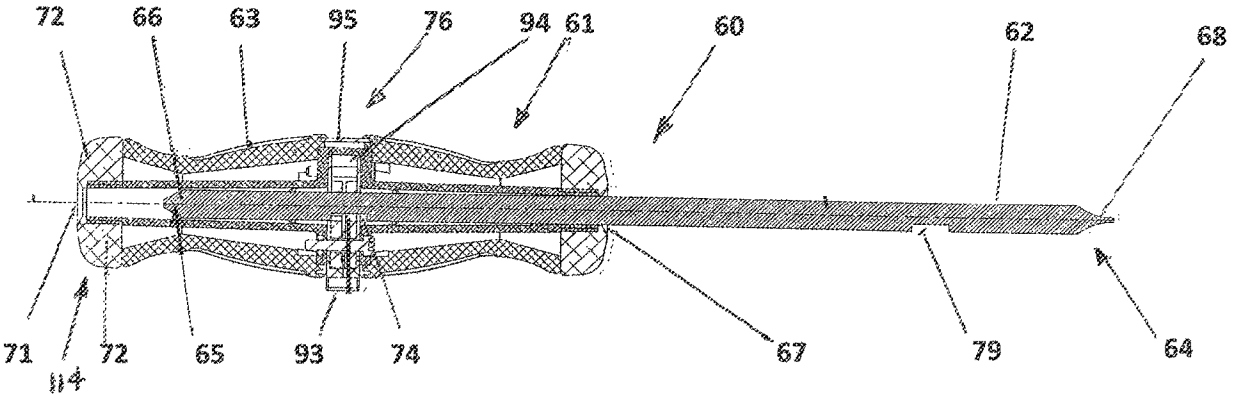
FIG. 20 shows with corresponding numbering a long section of the tool of FIG. 19 rotated axially 90 degrees.

FIG. 20 shows with corresponding numbering the tool of FIG. 19 rotated 90 degrees. Formation 75 (see FIG. 19) includes a longitudinal recess 75 and slots 74 and 79. Slots 74 and 79 allow retention of handle 63 against shaft 62. Formation 75 (see FIG. 15) which is configured to receive handle 63 enables the handle to be selectively and slidably retained on shaft 62. End 65 of shaft 62 is shown terminated short of end 114 of handle 63. This shaft 62 can penetrate beyond end cap 72 as handle 63 is moved towards end 64 when the tool is to be reversed. Also, handle 63 can be positioned on shaft 62 so that end 65 stops short of or abuts stop 71 of end cap 72.

Figure 21:
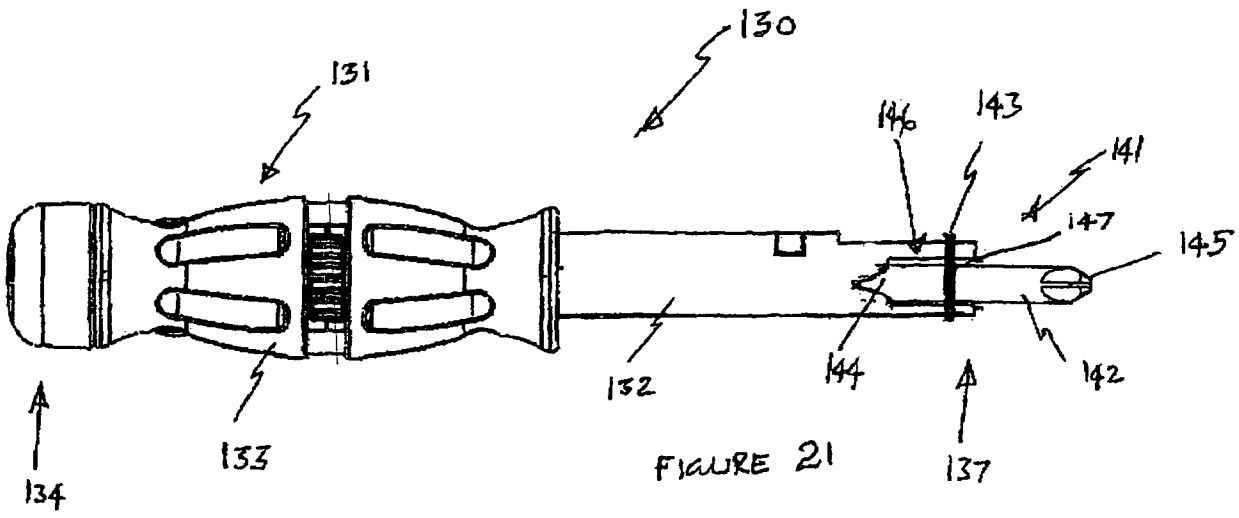
FIG. 21 is a perspective view of a reversible hand toll according to another preferred embodiment of the invention with an adjustable working end.

In a further embodiment of the invention as shown in FIG. 21, the working end of the shaft may be adapted with an adjustable working end which enables the user to selected two working formations at one or either end. FIG. 21 shows a side elevation view of a reversible hand tool 130 according to an alternative embodiment. Tool 130 includes handle assembly 131 which is adapted to slide along shaft 132 enabling handle 133 to be set at one end 134 of shaft 132, creating at opposite end 135 a working formation 136. Handle assembly 131 is connected concentrically to shaft 132 and is capable of travel therealong. Handle assembly 131 co operates with shaft 132 to allow the handle 133 to move along the shaft 132 between a first position at end 134 and a second position at end 137. Working end 137 is used while a user grips the handle 133.

According to a preferred embodiment, the handle 133 is lockable to prevent relative movement between the shaft 132 and the handle assembly 133 when either the first or second ends 134 or 137 have been selected. Stop 139 of end cap 140 is employed to ensure handle 133 does not release from shaft 132 beyond handle 133. End 137 is characterised in that it comprises a reversible working head 141 mounted on shaft 132. Head 141 comprises a working tip 142 mounted on pivot hinge 143. Shaft 132 has a bifurcated portion 146 which receives and retains working tip 142 such that working tip 142 can rotate either through 180 degrees or through 360 degrees about pivot hinge 143 thereby allowing a user to select alternative working end profiles 144 and 145. In an alternative embodiment, working tip 142 may be adapted for release from recess 147 defined by bifurcated portion 146 so that a user can extract (pull out) working tip 142 and reverse it so that working profile 145 is inserted in recess 147 and profile 144 is presented as the working formation. In this latter embodiment, the profile of working tip 142 is shaped to ensure a key in lock co-operation with recess 147 to ensure there is no relative rotation between working tip 142 and shaft 132 when a user applies torque to the tool. The above arrangements described in FIG. 21 may be adapted at either end of shaft 132 so that the user has according to one embodiment, up to four working profile options to choose from.

The embodiments previously described are examples only and it will be appreciated by persons skilled in the art that the configuration may be adjusted to accommodate a work tool assembly of different sizes, modes of operation, and configurations. For example the shaft may have a hexagonal, polygonal or other suitable cross sectional geometrical profile along either part of its length or over its full length. The shaft may have one cross section at one end and an alternative cross section at its opposite end. The present invention obviates the disadvantages of the prior art and provides other advantages which are apparent from the description herein. In certain cases the invention will be adapted to accommodate prescribed requirements and applications.

It will be further appreciated that the work tool described herein, can be manufactured with a variety of working end options. For instance the profile part on the shaft which forms each working end, can be selected from a variety of working formations. For example, a work tool may incorporate on one work end a flat end screw driver and at its other end a Philips head screw driver. Alternatively, the working ends may be selected from male or female alien keys of the same or different sizes or and any combination of those along with a flat end or Philips head end. Each working end formation may be provided in different sizes.

It will be appreciated that the above description relates to the preferred embodiment by way of example only. Many variations on the invention will be obvious to those knowledgeable in the field, and such obvious variations are within the scope of the invention as described and claimed, whether or not expressly described.

It will be recognised by persons skilled in the art that numerous variations and modifications may be made to the invention described herein without departing from the overall spirit and scope of the invention.

The claims defining the invention are as follows:

1. A reversible hand operated screwdriver, comprising:

a shaft having a circular cross section for at least part of its length and including first and second working ends at opposite ends of said shaft; and a cooperating handle mounted on said shaft wherein a longitudinal axis through said handle is concentric with a longitudinal axis through said shaft;

said handle being capable of sliding therealong between said working ends of said shaft;

wherein said screwdriver can be adjusted without removal of said handle from said shaft, to move from a first working orientation to a second orientation by sliding said handle along said shaft intermediate said working ends; wherein said shaft includes at least one formation intermediate said working ends cooperating with a locking assembly associated with said handle and which enables locking of said handle from relative movement along said shaft, and wherein said locking assembly selectively engages said shaft to effect locking of said handle against said shaft;

and wherein said locking assembly comprises a housing, a saddle including a formation for movement of said saddle relative to said housing, an actuating member pivotally attached within said housing and which includes an engaging arm and a tab which is received in a recess defined in said saddle; and wherein said actuating member pivots about a pivot pin thereby enabling said actuating member to advance towards said shaft and retract away from said shaft responsive to circumferential movement of said saddle; and wherein said at least one formation of said shaft receives a profile part of said engaging arm of said actuating member, when said actuating member and advances toward said shaft responsive to travel of said formation; and wherein said profile part of said engaging arm of said actuating member and said actuating arm define a slot in which said shaft is allowed to travel when said actuating member is retracted away from said shaft.

2. A screwdriver according to claim 1, wherein:

said handle has finger grippable formations which facilitate application of torque.

3. A screwdriver according to claim 2, wherein:

said shaft of said screwdriver has at said first working end a flat head profile.

4. A screwdriver according to claim 3, wherein:

said shaft has at said second working end a flat head profile.

5. A screwdriver according to claim 4, wherein:

said first and second working end flat head profiles are different sizes.

6. A screwdriver according to claim 2, wherein:

said shaft of said screwdriver has at said first working end a Philips head profile.

7. A screwdriver according to claim 6, wherein:

said shaft has at said second working end a Philips head profile.

8. A screwdriver according to claim 7, wherein:

said first and second working end Philips head profiles are different sizes.

9. A screwdriver according to claim 2, wherein:

said shaft of said screwdriver has at said first working end a male alien key profile.

10. A screwdriver according to claim 9, wherein:

said shaft has at said second working end a male alien key profile.

11. A screwdriver according to claim 10, wherein:

said first and second working end male alien key profiles are different sizes.

12. A screwdriver according to claim 11, wherein:

said shaft of said screwdriver has at said first working end a female hex key profile.

13. A screwdriver according to claim 12, wherein:

said shaft has at said second working end a female hex key profile.

14. A screwdriver according to claim 13, wherein:

said first and second working end female hex key profiles are different sizes.

15. A screwdriver according to claim 1, wherein:

said handle comprises first and second sleeve members which are retained concentrically along said shaft and wherein at least one of said sleeve members engage said locking assembly.

16. A reversible hand operated screwdriver, comprising:

a shaft including first and second working ends at opposite ends of said shaft; and a cooperating handle mounted on said shaft wherein a longitudinal axis through said handle is concentric with a longitudinal axis through said shaft;

said handle being capable of sliding therealong between said working ends of said shaft;

wherein, said screwdriver can be adjusted without removal of said handle from said shaft, to move from a first working orientation to a second orientation by sliding said handle along said shaft intermediate said working ends; wherein said shaft includes at least one formation intermediate said working ends cooperating with a locking assembly associated with said handle and which enables locking of said handle from relative movement along said shaft, and wherein said locking assembly selectively engages said shaft to effect locking of said handle against said shaft;

and wherein said locking assembly comprises a housing, a saddle including a formation for movement of said saddle relative to said housing, an actuating member pivotally attached within said housing and which includes an engaging arm and a tab which is received in a recess defined in said saddle; and wherein said actuating member pivots about a pivot pin thereby enabling said actuating member to advance towards said shaft and retract away from said shaft responsive to circumferential movement of said saddle; and wherein a profile part of said engaging arm of said actuating member defines a slot in which said shaft is allowed to travel when said actuating member is retracted away from said shaft.

* * * * *